United States Patent [19]

Naumann

[11] 4,085,646

[45] Apr. 25, 1978

[54] ELECTRONIC MUSICAL INSTRUMENT

[76] Inventor: Klaus Naumann, Friedrich-Panzer-Weg 6 D-8000, Munich 83, Germany

[21] Appl. No.: 690,557

[22] Filed: May 27, 1976

[30] Foreign Application Priority Data

May 28, 1975 Germany ..... 2523623

[51] Int. Cl.[2] ..... G10H 3/02; G10H 5/00

[52] U.S. Cl. ..... 84/1.09; 84/1.11; 84/1.19; 84/1.22; 84/1.25; 84/1.27; 179/1 MN; 179/1 VC

[58] Field of Search ..... 84/1.01, 1.03–1.06, 84/1.09–1.11, 1.17–1.19, 1.22–1.25, 1.27, DIG. 8, DIG. 9, DIG. 10, DIG. 12, DIG. 19, DIG. 20; 179/1 MN, 1 VC

[56] References Cited

U.S. PATENT DOCUMENTS

| | | | |
|---|---|---|---|
| 3,730,046 | 5/1973 | Spence | 84/1.05 |
| 3,767,833 | 10/1973 | Noble et al. | 84/1.01 |
| 3,828,110 | 8/1974 | Colin | 84/1.01 |
| 3,878,748 | 4/1975 | Spence | 84/1.05 |
| 3,897,709 | 8/1975 | Hiyoshi et al. | 84/1.19 |

*Primary Examiner*—Stanley J. Witkowski
*Attorney, Agent, or Firm*—Craig & Antonelli

[57] ABSTRACT

An electronic musical instrument providing continuous cybernetic tone finding controlled by functions of the human mouth. The instrument includes a mouthpiece into which air is to be blown from the mouth of a player having a measuring apparatus at least partially mounted therein. The measuring apparatus includes an arrangement for producing a pitch determining signal representing a measure of the mouth cavity of the player and a volume determining signal representing the velocity or pressure of the air blown into the mouthpiece. Tone generating apparatus is provided for generating a tone signal whose frequency varies with the level of a control signal applied thereto with a control signal being applied to the tone generating apparatus in accordance with the pitch determining signal and having a level representing a measure of the mouth cavity of the player. Another control signal in accordance with the volume determining signal serves for controlling the output of the tone generating apparatus with the output being converted to sound.

49 Claims, 20 Drawing Figures

KEYBOARD TA 1
KEYBOARD TA 2
KEYBOARD TA 3
KEYBOARD TA 4
FS
FOOT SWITCH
ELECTRONIC BE SYSTEM
VIBRATO VG GEN.
PV
AMP. V2
AMP. V1
PF
SWITCH AMP. SV
G GEN.
F FILTER
DAMPING D MEMBER
PRE AMP. V3
PL
POWER LV AMP.
L
POWER N SUPPLY
PRODUCES REGULATED D.C. VOLTAGES
UV UNIVERSAL AMPLIFIER
M
LS
TS
MU
SE
TK
TE
13
111
112
114
115
116
117
118
119
120
121
122
123
124
125
126
127
128
129
130
131
132
133

ELECTRONIC MUSICAL INSTRUMENT

The present invention relates in general to electronic musical instruments, and more particularly to a continuous cybernetic tone finding system, wherein the amplifying and tone and sound producing units are controlled by operations performed by the human mouth in association with two measuring systems operating simultaneously and in parallel to detect such operations.

Musical instruments can be divided into three groups. The first group, such as the piano, produces fixed notes. The second group, such as the trombone, does not produce fixed notes. The third group comprises intermediate forms of the first and second groups. The instruments in the second group, where the prefect pitch is obtained by means of a continuous pitch finding process, place high demands on the musical ability of the individual playing the instrument and require that he employ a regulating method, i.e., that he set the pitch-listen to it-compare it-correct the pitch.

The present invention relates to an electronic musical instrument belonging to the second group. There is no known electronic instrument based on the principle of this electronic musical instrument. All the conventional instruments have the disadvantage that the process of learning to play them is very difficult and time consuming. This disadvantage is to be obviated by the present invention.

During the operation of blowing, air is blown out of a person's mouth through the lips which are formed specially to produce a particular sound, the pitch of which is largely determined by the cavity formed in the mouth by the tongue and teeth. The intensity of this sound depends on the velocity of the air. The operations of blowing and forming a cavity are parallel harmonized operations forming part of a control method, which is completed by the operations of hearing and correcting the pitch.

The principal object of the present invention is to provide an electronic musical instrument which is based on a continuous cybernetic tone finding system of operation.

Another object of the present invention is to provide an electronic musical instrument which is easy to learn and play.

A further object of the present invention is to provide an electronic musical instrument which operates in response to the natural functions of the human mouth, and therefore, is easy to play.

A further object of the present invention is to provide an electronic musical instrument having no pitch selector comprising a plurality of keys which the player must operate to select the desired pitch.

Still another object of the present invention is to provide an electronic musical instrument which is capable of providing a selectively wide range of tones under control of the player of the instrument.

The objects of the present invention are accomplished through use of the natural functions of the human mouth, which are employed when blowing through the lips, especially when blowing through the lips in a whistling manner, to control the tone frequencies electronically produced in a tone and sound generating unit, these natural functions being determined by means of two measuring systems which produce tone and volume signals, respectively, the tone signal being applied to control a tone generator whose output is connected to a first input of a modulation or preamplifier unit, and the volume signal being applied to a second input of said preamplifier unit whose output is connected to an electro-acoustical transducer, for producing the appropriate musical tones.

These and other objects, features, and advantages of the present invention will become more apparent from the following detailed description of an exemplary embodiment thereof, as illustrated in the accompanying drawings, in which:

FIG. 1 is a schematic diagram of one type of pitch determining measuring system in accordance with the present invention;

FIG. 1*a* is a schematic diagram of a second type of pitch determining measuring system in accordance with the present invention;

Figure 12:
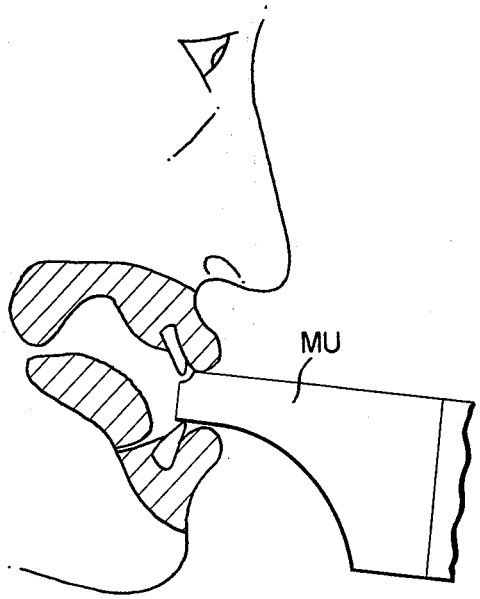
FIG. 12 is a schematic illustration of the mouth cavity and instrument mouthpiece.

A person may produce a particular sound by blowing air out of the mouth through the lips with the lips formed to a particular shape, and the pitch of that sound will depend on the size and shape of the cavity formed in the mouth by the tongue and teeth. As seen in FIG. 12, when playing a wind instrument, the outer end of the mouthpiece MU of the instrument is gripped between the incisor teeth and is surrounded by the lips to close off the cavity formed in the mouth. The present invention is based on the control of an electronic musical instrument using the natural functions of the mouth as measured by devices at least partially located in the mouthpiece MU of the instrument. Such devices not only measure air velocity or air pressure, but also the cavity in the mouth formed by the palate, cheeks, tongue, teeth, and lips, or a quantity indicative of the cavity, such as the distance between the mouthpiece and the tongue.

The electronic musical instrument in accordance with the present invention has two main technical functions to perform. Each of these technical functions can be performed in various ways, and therefore, they will be considered separately.

Figure 1:
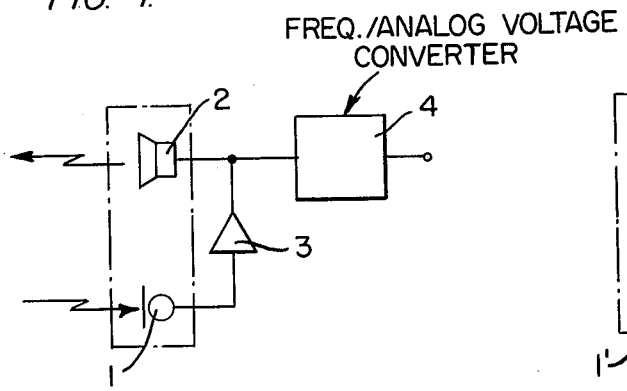

The first technical function relates to the measurement of the mouth cavity or the distance between the mouthpiece and the tongue on the one hand, and the air pressure or the air velocity on the other hand. One means of measuring the mouth cavity is illustrated in FIG. 1, and consists of a sonic or ultrasonic receiver 1 connected through an amplifier 3 to the input of a frequency 1 analog voltage converter 4. The receiver 1 is also connected via the amplifier 3 to the input of a sonic or ultrasonic transmitter 2. The measuring device illustrated in FIG. 1 is preferably located in the mouthpiece MU and forms a system similar to an oscillator having a resonant cavity in which an acoustical feedback is produced in the mouth cavity at the resonant frequency determined by the parameters of the mouth cavity. Thus, specific frequencies depending on the size of the mouth cavity are continuously produced by this system, when blowing into the mouthpiece MU, and an analog voltage level corresponding thereto is provided at the output of the converter 4.

Figure 1A:
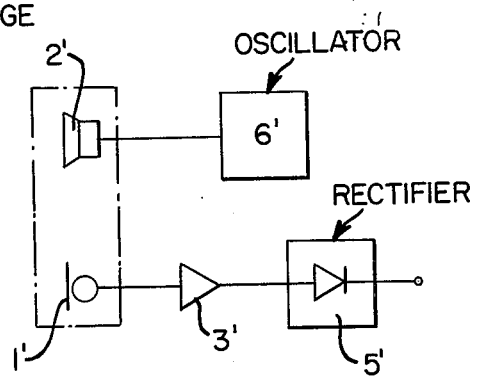

Departing from the representation in FIG. 1 and according to FIG. 1*a*, the measuring device may comprise a sonic or ultrasonic receiver 1' whose output is connected to the input of an amplifier 3' being connected to a diode rectifier 5' whose output signal represents the measuring signal. The device further comprises a sonic or ultrasonic transmitter 2' whose frequency is set to a fixed value by an oscillator 6'. This device measures the distance from tongue to mouthpiece on grounds of amplitude measurement of the reflected wave.

Figure 2:
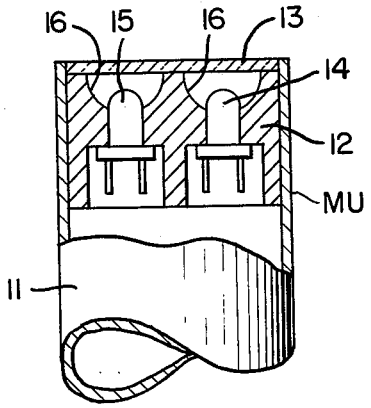
FIG. 2 is a partial sectional view of a mouthpiece including part of another pitch determining measuring system in accordance with the present invention.

A low cost arrangement for measuring the mouth cavity which is based on a measurement of the distance between the person's tongue and the mouthpiece MU is illustrated in FIG. 2. In this arrangement, a light emitter 14 and a light receiver 15 are disposed in side-by-side relationship within the mouthpiece MU, light emitting diodes and phototransistors being especially suitable for this purpose. The intensity of light reflected from the tongue of the person playing the instrument is measured by a standard detecting circuit including an amplifier connected to the light receiver 15 and then provides a d.c. signal indicative of the distance between the mouthpiece and the player's tongue, which forms a measure of the mouth cavity.

The light emitter 14 may be of the type that emits light that is invisible for the human eye, such as infrared light, and accordingly, the light receiver 15 may be of the type that measures invisible light.

The light emitter 14, in the form of an emitting diode, and the light receiver 15, in the form of a phototransistor, are preferably mounted in an opaque holder 12 with the sensitive surfaces thereof extending into respective parabolic cavities which are coated with a light reflecting coating 16. A transparent plate 13 of plastic or glass material covers the end of the mouthpiece 11 as a cover for the parabolic cavities; in the alternative, separate covers for each parabolic cavity could be provided. The parabolic cavities and the opaque holder serve to confine and concentrate the light so as to provide maximum sensitivity.

Figure 3:
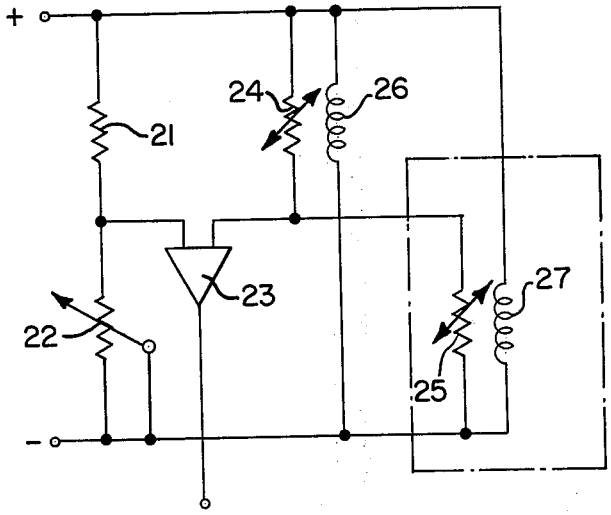
FIG. 3 is a schematic circuit diagram of an air velocity measuring system in accordance with the present invention.

The air velocity or the air pressure also is to be measured to determine magnitude or volume of the tone to be generated as well as to control the pitch. One arrangement for providing such measurement of the air velocity is illustrated in FIG. 3, and consists of a resistance bridge circuit comprising two preheated measuring resistances 24 and 25 connected in series across a d.c. power source, one being arranged inside the air current in the mouthpiece and the other being arranged outside the air current. The bridge is completed by a resistor 21 connected in series with a variable resistor 22 across the power source. The points of connection of the two series circuits are connected to respective inputs of an amplifier 23, whose output provides a measure of the air velocity resulting from any imbalance in the bridge resulting from a difference in impedance between the resistors 24 and 25. In the illustrated arrangement, the resistor 25 is heated by a heater 27 and is enclosed so as to be inside of the air stream; while, the resistor 24 is heated by a heater 26 and is located outside of the air stream. The resistor 25 will therefore be cooled by the air stream so as to have a temperature different from that of the resistor 24 thereby unbalancing the bridge and providing a d.c. voltage output from the amplifier 23. Of course, a system operating on the basis of ambient temperature could be provided in which the heaters 26 and 27 were eliminated without serious loss of advantage.

Figure 4:
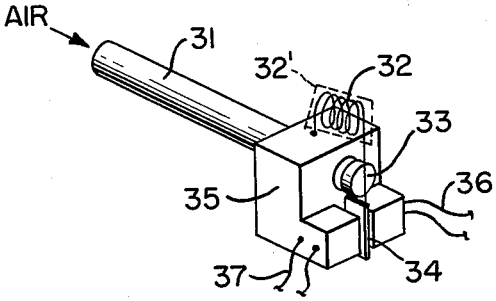
FIGS. 4 and 5 illustrate respective air pressure measuring devices in accordance with the present invention.

The air pressure in the mouthpiece may be measured by means of a device of the type illustrated in FIG. 4. This device consists of a light emitter 36 and a light receiver 37 disposed in line with one another within a housing 35. A steel wire spring 32 has one end secured to the housing 35 and the other end forming a linear lever arm connected to a closure member 33 for closing one end of an air inlet tube 31 through which the air passes in the mouthpiece. The extreme end of the lever arm formed by one end of the spring 32 is connected to a light shield 34 which is normally located between the light emitter 36 and the light receiver 37 when no air is flowing through the deivce. Depending on the pressure of the air passing through the tube 31, the closure member 33 will be displaced against the bias of the spring 32 so as to move the light shield 34 away from the direct line between the light source 36 and the light receiver 37, thereby controlling the amount of light which is permitted to pass from the light emitter 36 to the light receiver 37. The light receiver 37 thus provides a d.c. voltage output which is a measure of the air pressure.

Figure 5:
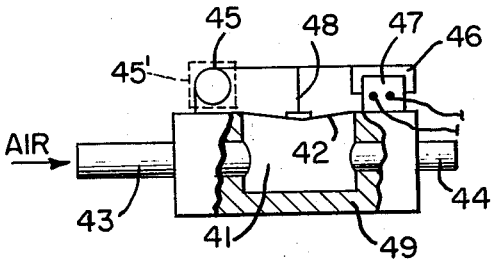

An alternative arrangement for measuring air pressure is illustrated in FIG. 5. This device measures air pressure by measuring pressure difference, and consists of a hollow chamber 41 formed in a body 49 having a flexible wall 42 forming a diaphragm for the chamber. An air supply tube 43 provides air to the chamber 41 and an air outlet tube 44 provides an air outlet for the chamber. The air inlet tube 43 is of larger diameter than the air outlet tube 44 so that when air is blown into the chamber 41, the outlet being relatively restricted, a pressure is built up in the chamber 41 causing a deflection of the diaphragm 42 in dependence on the magnitude of the air pressure. One end of a plunger 48 is touching the diaphragm 42, and at the other end is connected to a lever arm forming one end of a steel wire spring 45, the other end of which is secured to the body 49. The extreme end of the lever arm of the steel spring 45 is connected to a light shield 46 disposed in the path between a light emitter (not shown) and a light receiver 47. Thus, deflection of the diaphragm 42 will cause movement of the light shield 46 to an extent depending upon the magnitude of the deflection, and the extent of this movement can be detected by the magnitude of the light which is received by the light receiver 47, which provides a d.c. voltage representative of air pressure.

In the arrangement such as illustrated in FIGS. 4 and 5, a vibration damping material may be provided for the steel spring 32 or 45, respectively; for example, the spiral part of the spring may be embedded in the vibration damping material 32' and 45', respectively shown in dashed line. In addition, Hall-effect devices, magnetic devices, and semiconductor arrangements of known construction can be utilized instead of the optical arrangements described to measure the extent of deflection of a body produced by the air flowing in the mouthpiece MU. Other modifications based upon the general principles described in connection with the devices illustrated in FIGS. 4 and 5 will be obvious to those of skill in this particular art.

Figure 6:
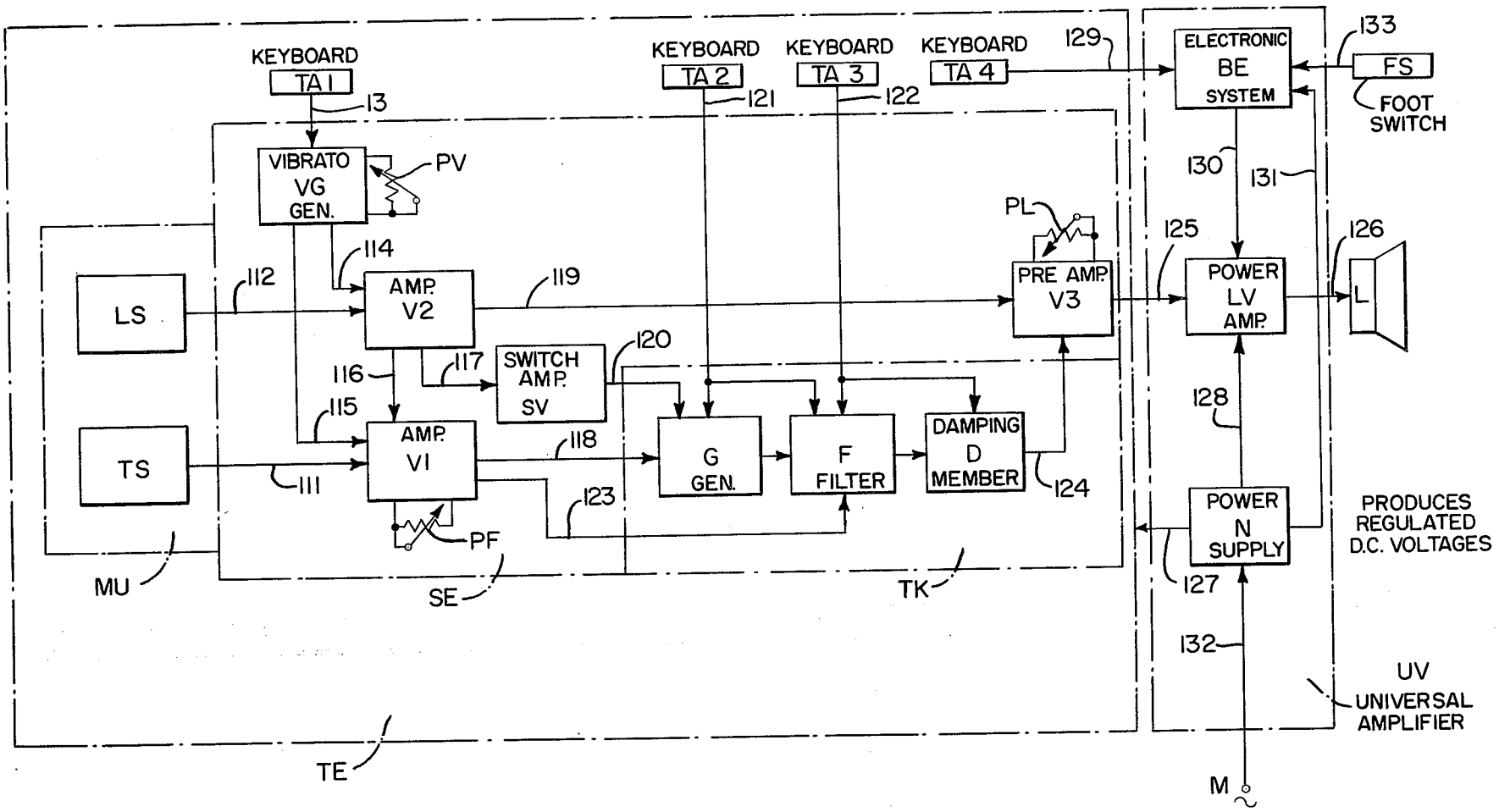
FIG. 6 is a schematic block diagram of the electronic control system in accordance with this invention.

The second main technical function to be performed by the present invention is that of electronic control and tone and sound generating in response to the measurements of mouth cavity or distance and air pressure or air velocity provided by the devices illustrated in FIGS. 1 through 5. The electronic control system which performs this function is illustrated in FIG. 6.

Two measuring systems TS and LS, which are fully or partially housed in the mouthpiece MU, measure the functional behavior of the mouth of the person playing the instrument. The pitch determining measuring system TS measures the cavity in the mouth formed by the palate, cheeks, tongue, teeth, lips, and the mouthpiece MU, or merely the distance between the mouthpiece MU and the tongue. The volume determining measuring system LS simultaneously measures the air velocity and/or air pressure when air is blown out of the mouth through the mouthpiece MU. The measurement output signal of the pitch determing measuring system TS after appropriate processing by a first amplifier V1, controls a tone generator G to produce the tone frequency and possibly also a filter F, generator G and filter F being incorporated in a tone and sound generating unit TK. the measurement output signal of the volume determining measuring system LS, after appropriate processing by a second amplifier V2, simultaneously enables a preamplifier V3, which is used as a modulator unit, and controls the amplification of the tone frequencies applied through the preamplifier V3. It may also enable the tone generator G through a switching amplifier SV. The sound intensity is continuously controlled by controlling the amplification factor of a preamplifier V3 having a controllable amplification factor, or by controlling a damping member (not shown) connected in series with a preamplifier V3 whose amplification factor is constant. The amplifiers V1, V2, and V3 form parts of an electronic control system SE.

The tone frequencies produced in the tone and sound generating unit TK under control of the pitch determining measuring system TS and modulated in the preamplifier V3 under control of the volume determining measuring system LS are amplified by a power amplifier LV, and audibly reproduced through an electroacoustical transducer or loudspeaker L. A universal amplifier unit UV includes the power amplifier LV and a power supply unit N, which is fed by a mains connection power supply M.

The unit BE connected to power amplifier LV via line 130 is a commercial electronic device that produces, for example, a base rhythm with a characteristic acoustic pattern. This acoustic pattern consists of digitally controlled tones that are combined to constitute an acoustic pattern. This device may be controlled from keyboard TA4 via line 129 or by foot switch FS via line 133. Power is supplied to the device from power supply N via line 131.

The electronic musical instrument illustrated in FIG. 6 is comprised by a portable unit TE, the power amplifier LV, and the transducer L. The portable unit TE consists of the mouthpiece MU, the electronic control system SE, the tone and sound generating unit TK, various keyboards TA1 through TA3, and various potentiometers. With this unit TE, which is connected via leads to the universal amplifier unit UV, the player's hands remain free while playing and may be used to perform special operations, such as switching between the sounds of different instruments, for example, from trumpet to clarinet, selecting types of modulation, providing tone range shifts, or adjusting potentiometers for the vibrator frequency, the frequency range of the volume level.

The electronic control system SE may be used with different tone and sound generating units TK. The system SE shown in FIG. 6 consists of the amplifiers V1 and V2, the switching amplifier SV, the preamplifier V3, and a vibrato generator VG. The tone determining measurement values derived from the device TS in the mouthpiece MU is applied via line 111 to a first input of the first amplifier V1. The first input is comparable to the normal signal input of a usual amplifier. A second input of the amplifier V1 receives the output of the vibrato generator VG via line 115. The second input is a modulating input. Its varying input signal causes corresponding modulation on the output of the anmplifier V1. It further causes frequency modulation of the output of generator G. The first amplifier V1 may be further controlled by the volume measurement output signal derived from the second amplifier V2 via line 116, for the purpose of tonal range shifting, and/or by the setting of a potentiometer PF connected to the first amplifier V1, for the purpose of tonal range alteration. The output of amplifier V1 is a d.c. voltage which is applied via line 118 for controlling the output frequency of the generator G in a continuous manner as the cavity in the human mouth or the distance between the tongue and the mouthpiece varies. The control is such that with decreasing cavity or decreasing distance between teeth and mouthpiece, the output frequency of the generator G increasing. The output of the first amplifier V1 may further be applied for controlling the filter F in the tone and sound generating unit TK via line 123. The amplifier V1 is preferably responsive to both of the signals on lines 111 and 116, in such a way that if the signal on line 111 is constant and the signal on line 116 increases, the output signal of the amplifier V1 will increase less than proportionally. This feature of the amplifier V1 will approach the behavior of the musical instrument when blowing into it to circumstances prevailing when a person is whistling through the lips.

Figure 13:
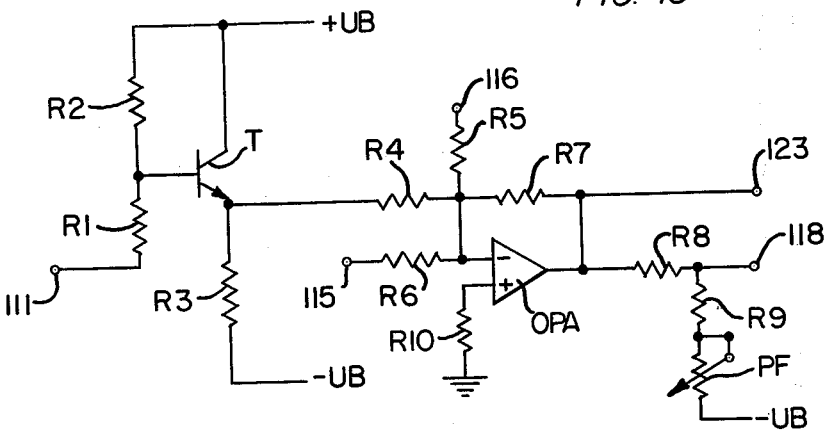
FIG. 13 is a circuit diagram of an example of the amplifier V1 of FIG. 6.

FIG. 13 illustrates one example of the amplifier V1 as provided in the system of FIG. 6. The signal on line 111 is applied through a resistance R1 to the base of a transistor T, whose collector electrode is connected to the positive side of a power source $U_B$. The base of the transistor T is also connected through the resistor R2 to the collector thereof and the emitter is connected through resistor R3 to the negative side of the power supply $U_B$. The emitter of the transistor T is connected via a resistor R4 to the difference input terminal of an operational amplifier OPA of conventional type, such as the Fairchild 709 or 741 microamplifier or the Texas Instruments amplifier 72741.

The difference input of the amplifier OPA receives two additional signal sources. Firstly, the varying output signal from the vibrato generator VG is applied from line 115 via resistor R6. and secondly, the output from amplifier V2 is applied via line 116 through resistor R5 to the difference input of the amplifier. The sum input of the amplifier OPA is connected to ground through the resistor R10, and the feedback path for the amplifier is provided by the resistor R7, which is connected between the output of the amplifier and the difference input thereof.

The output of amplifier OPA is applied through resistor R8 to an output terminal connected to line 118. The output terminal is also connected through resistor R9 and the logarithmic potentiometer PF to the negative side of the power supply $U_B$. Thus, the output applied to line 118 to the tone generator G in the tone and sound generating unit TK corresponds to the direct current input signal received on line 111 from the pitch determining measuring system TS as modulated by the varying signal received on line 115 from the vibrato generator VG. The output level is controlled by the potentiometer TF as well as by the signal received on line 116 from the amplifier V2.

The output of the amplifier OPA is also applied to an output terminal connected to line 123 for controlling the filter F in the tone and sound generating unit TK, the level of which is independent of any control by the potentiometer PF.

Referring once again to FIG. 6, the volume determining measurement signal from the device LS is applied via line 112 to a first input of the second amplifier V2, a second input of which is connected via line 114 from the vibrato generator VG. The frequency of the vibrato generator VG is determined by the setting of the potentiometer PV. Amplitude control of the vibrato generator output may be provided by the keyboard TA1 via line 113. Thus, the second amplifier V2 enables the volume determining measurement output signal received on line 112 to be modulated more or less intensively as a function of the setting of the keyboard TA1 by the output on line 114 from the vibrato generator VG (amplitude modulation), it being possible to obtain the vibrating sound even of a mandolin. One output of the second amplifier V2 is applied via line 119 to control the amplification of the amplifier V3 thereby providing a volume control of the output of the amplifier V3 on line 125. As mentioned already before, a second output of the amplifier V2 is applied via line 117 in control of the switching amplifier SV to control tone releasing or generator connection of the generator G.

Figure 14:
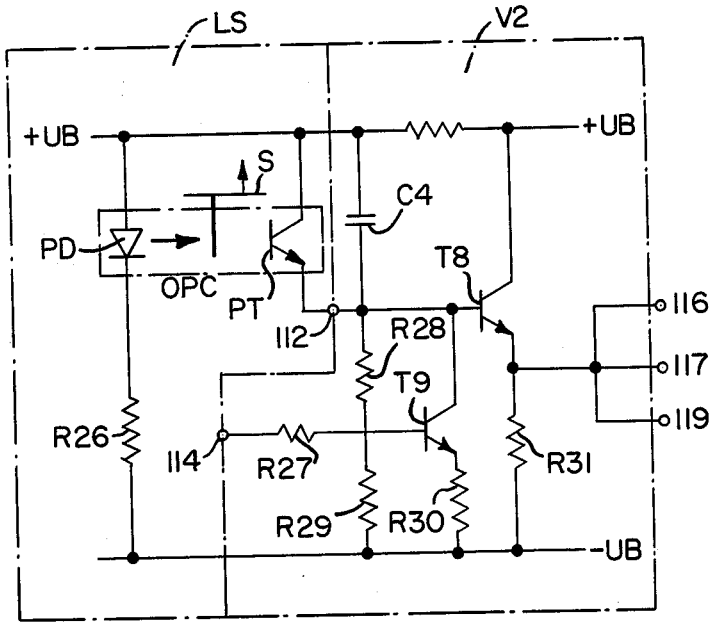
FIG. 14 is a circuit diagram of an example of the amplifier V2 of FIG. 6.
Figure 15:
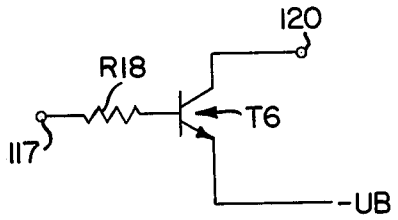
FIG. 15 is a circuit diagram of an example of the switching amplifier SV of FIG. 6.

FIG. 14 illustrates an example of an amplifier V2 of the type utilized in the system of FIG. 6, associated with a portion of the volume determining measuring system LS. The portion of the system LS illustrated includes an optical detecting device OPC, such as the detector OPB 120 manufactured by Optron, Inc., of Carrolton, Texas. The detecting unit includes a photodiode PD which emits light to be detected by a phototransistor PT. A shield S may be provided in the path between the photodiode PD and the phototransistor PT in the manner already described in connection with FIGS. 4 and 5. The photodiode PD of the detector OPC is connected across the power supply UB through the resistor R26 while the phototransistor PT is connected between the positive side of the power supply and the line 112 to the amplifier V2. The line 112 is connected to the collector of a transistor T9 whose emitter is connected through resistor R30 to the negative side of the power supply $U_B$. The base of transistor T9 receives the varying input signal on line 114 from the vibrator generator VG through resistor R27. The base of the transistor T9 is also connected to a point of connection between resistors R28 and R29 forming part of a series circuit including capacitor C4 connected across the power supply. The collector of transistor T9 is connected to an emitter follower stage formed by transistor T8, whose collector is connected to the positive side of the power supply and whose emitter is connected through resistor R31 to the negative side of the power supply. The emitter of transistor T8 provides the direct current signal on lines 116, 117, and 119 to the amplifier V1, the switching amplifier SV, and the preamplifier V3, respectively. FIG. 15 illustrates an example of the switching amplifier SV. The direct current signal on line 117 from the amplifier V2 is applied through resistor R18 to the base of a transistor T6, whose emitter is connected to the negative side of the power supply $U_B$. The collector of the transistor T6 is connected via line 120 to the tone generator G in the tone and sound generating unit TK and serves to switch on the tone generator G.

Figure 16:
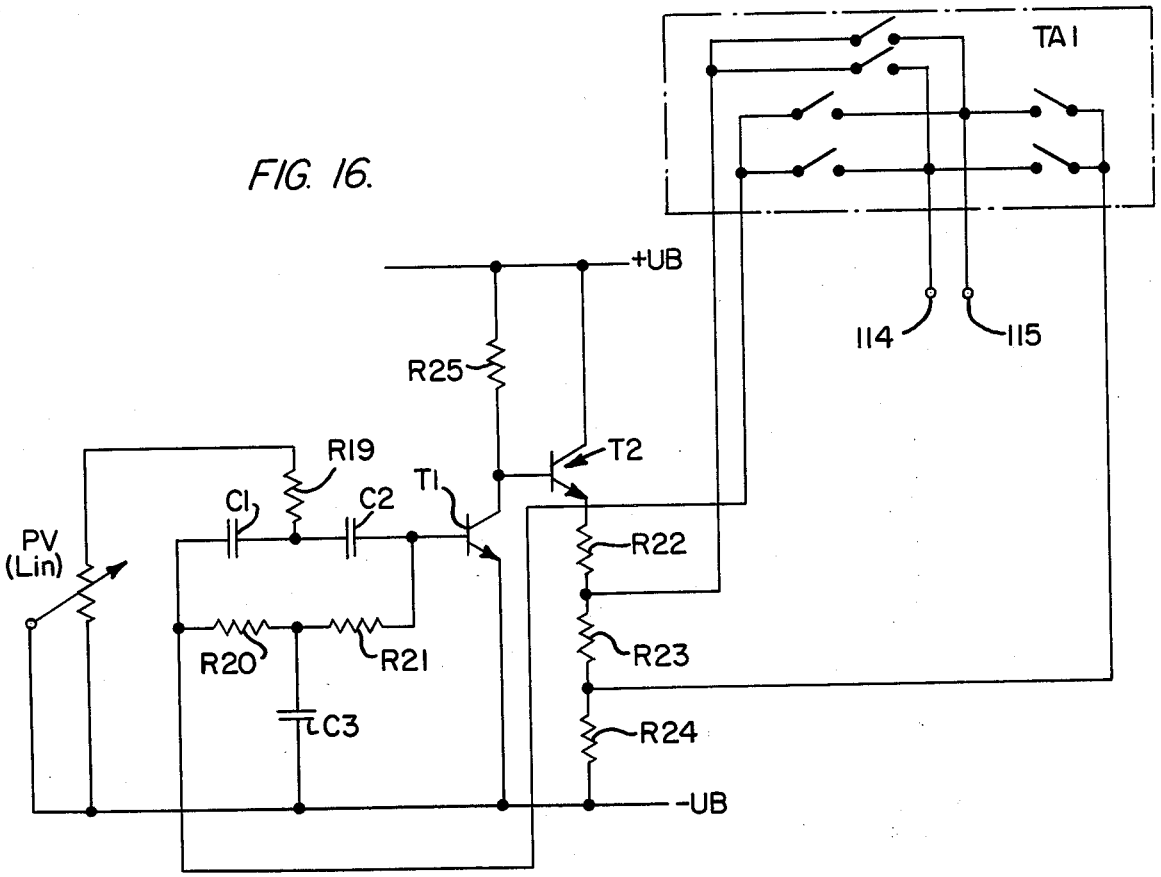
FIG. 16 is a circuit diagram of an example of the vibrato generator VG of FIG. 6.

FIG. 16 illustrates an example of the vibrato generator VG included in the system of FIG. 6. The vibrato generator VG comprises a transistor oscillator including the transistor T1. A tune circuit including resistors R19, R20, and R21, capacitors C1, C2, and C3 along with linear potentiometer PV is connected to the base of transistor T1, which is connected across the power supply $U_B$ through the resistor R25. The collector of the transistor T1 is connected to an emitter follower stage including the transistor T2 whose emitter is connected to the series resistors R22, R23, and R24. The various switches of the keyboard TA1 selectively connect the various taps of the emitter resistors to the output lines 114 and 115.

Figure 17:
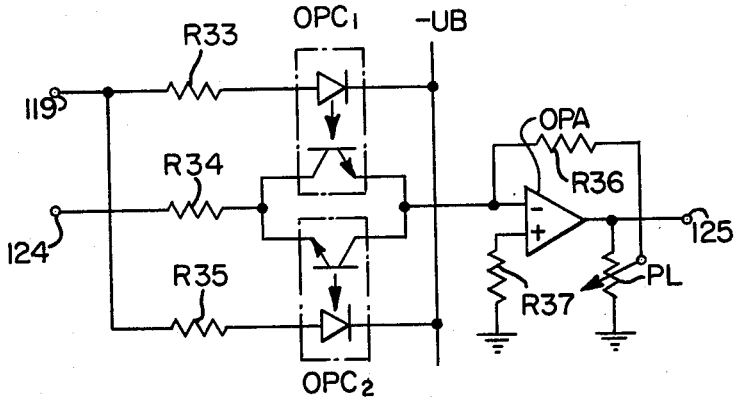
FIG. 17 is a circuit diagram of an example of the preamplifier V3 of FIG. 6.

An example of the preamplifier V3 is illustrated in FIG. 17. This amplifier includes a pair of optical photocells OPC1 and OPC2 as well as an operational amplifier OPA. The optical photocells may be of the type described above in connection with FIG. 14 and the operational amplifier may be of the type described in connection with FIG. 13.

The direct current signal received on line 119 is applied through resistor R33 to the photodiode of the optical cell OPC1 and is applied through the resistor R35 to the photodiode of the optical cell OPC2. The varying signal on line 124 from the tone and sound generating unit TK is applied via resistor R34 to both the phototransistors in the respective optical cells OPC1 and OPC2 and the level of this signal is thereby varied by the light emitted by the respective photodiodes in these cells. The phototransistors in the optical cells are connected in common to the difference input of the operational amplifier OPA, the sum terminal of which is connected through resistor R37 to ground. The feedback resistor R36 of the amplifier is connected to the tap of the potentiometer PL which is connected between the output of the amplifier OPA and ground. The output signal from the amplifier OPA is applied on line 125 to the power amplifier LV.

As noted already before, the frequency of the vibrato generator VG which selectively controls one or both amplifiers V1 and V2, can be adjusted by the potentiometer PV. The amplification and thus the volume level can be determined by setting a potentiometer PL at the preamplifier P3. Also, as an alternative, the amplifier V3 may provide a constant amplification factor, and a damping member controlled by the signal on line 119 may be provided in series with the amplifier V3.

The supply unit N supplies the necessary supply voltages for the portable unit TE and the power amplifier LV via lines 122 and 128, respectively.

Various embodiments of the tone and sound generating unit TK are possible. In FIG. 6 there is disclosed one example of such a generating unit TK in which the controllable and connectable tone generator G supplies a sawtooth or square-waved voltage in the low frequency range to the filter or filter combination F. When a plurality of filters are provided, these are damped selectively by a damping member or a damping member combination D. The frequency of the generator G can be switched in a stepwise manner along with the resonance frequency of the filter F by means of the keyboard TA2. The filter F and the damping member D can also be switched by the keyboard TA3 to vary the sound pattern.

Figure 18:
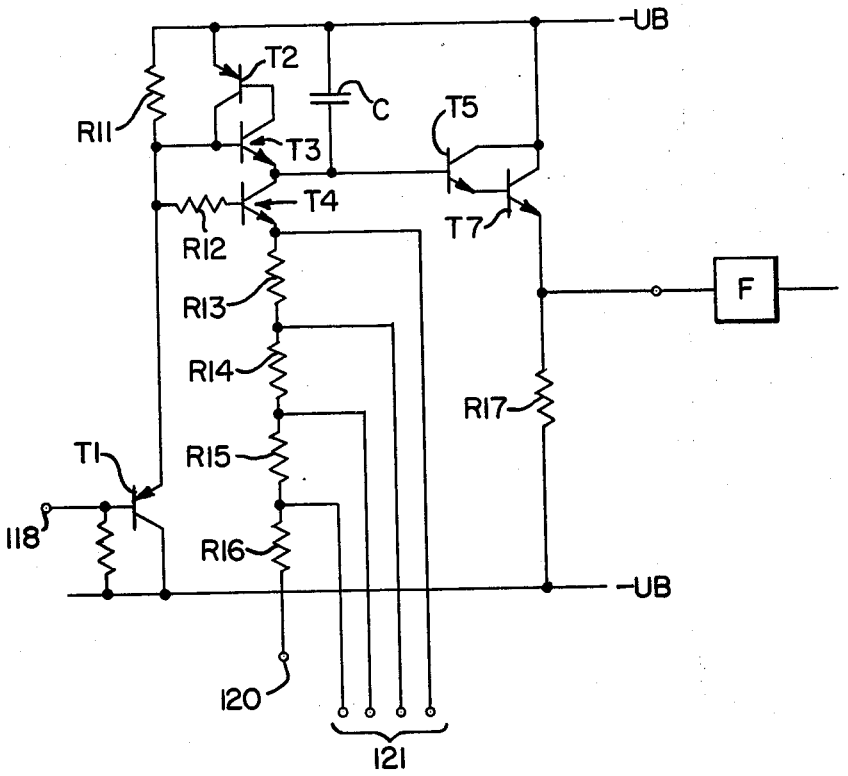
FIG. 18 is a circuit diagram of an example of a tone generator G.

An example of a generator G of the type providing a sawtooth output voltage is illustrated in FIG. 18. An input transistor T1 has its base connected to the line 118 from the amplifier V1. The transistor T1 has its collector connected to the negative side of the power supply and its emitter connected through resistor R11 to the positive side of the power supply $U_B$. An oscillator circuit formed by opposite conductivity type transistors T2 and T3 and capacitor C are connected in series with transistor T4 and resistances R13, R14, R15, and R16 to the terminal 120. As described in connection with FIG. 15, operation of the switching amplifier SV in response to the output of the amplifier V2 on line 117 serves to connect the negative side of the power supply through transistor T6 to the line 120. This completes the connection of the oscillator across the power supply through the transistor T4 permitting operation of the generator. The various resistors R13 through R16 may be selectively switched by the keyboards TA2 via the lines 121.

Transistors T5 and T7, connected in Darlington configuration, are connected to the collector of the transistor T4. The output from the generator is applied from the emitter of transistor T7 to the filter circuit F.

Figure 19:
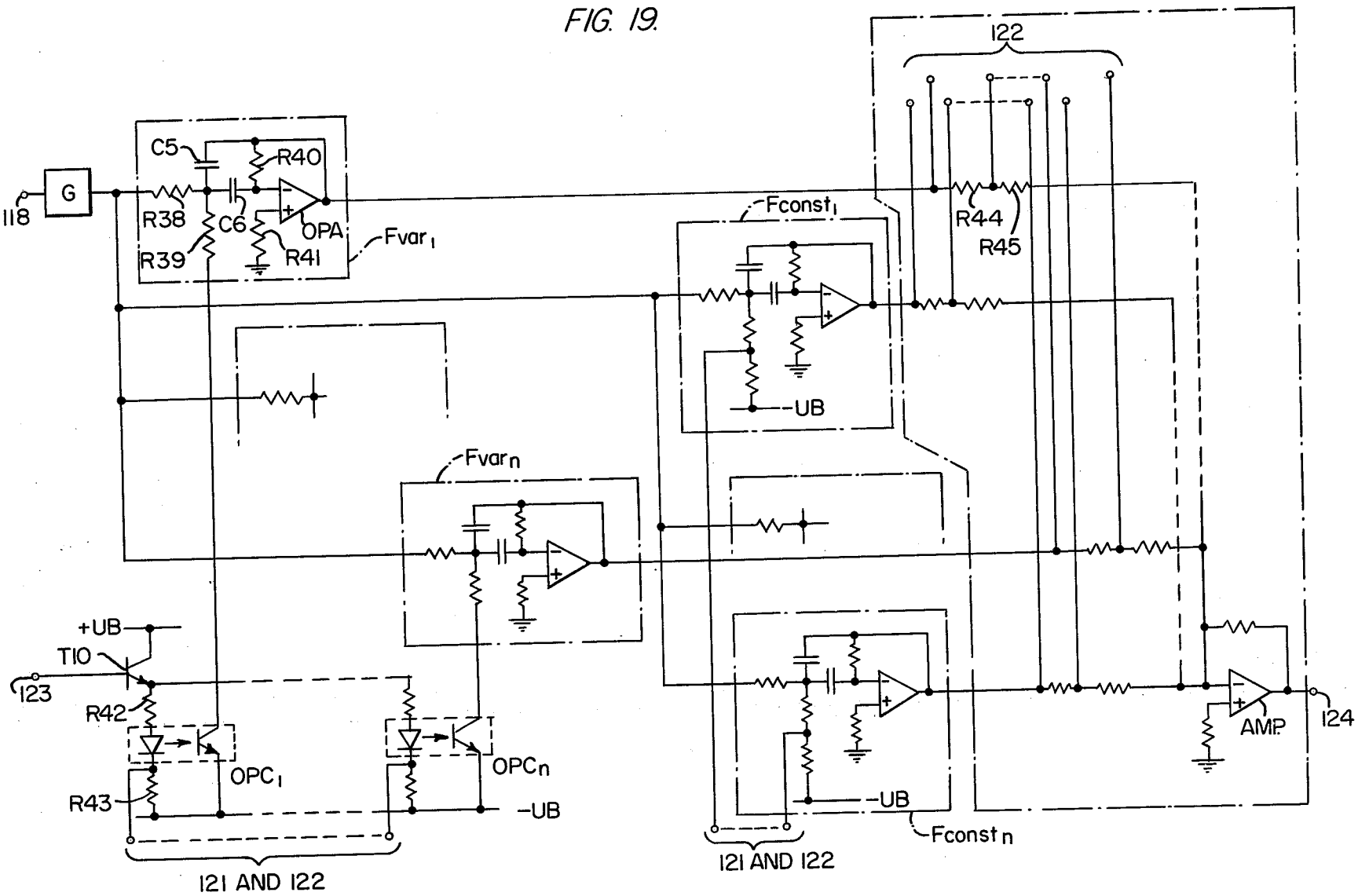
FIG. 19 is a circuit diagram of an example of a filter arrangement and damping member combination.

FIG. 19 illustrates an example of a filter arrangement F and damping arrangement D of the type which may be used in the system of FIG. 6. A plurality of voltage tuned active filter $F_{var1}$ through $F_{varn}$ are each connected to the output of the tone generator G. Each voltage tuned active filter is comprised of an operational amplifier OPA having an input filter arrrangement comprising resistors R38, R39 and capacitors C5 and C6 connected to the difference input of the amplifier. Resistor R40 provides the feedback path from the output of the amplifier to the difference input thereof, and the resistor R41 connects the sum input of the amplifier to ground. The variable filters $F_{var}$ are each controlled by a respective optical cell arrangement OPC1 through OPCn connected in common to the output of a transistor T10 whose base is connected to the control signal supplied on line 123 from the amplifier V1. The transistor T10 is connected in series with resistor R42, the photodiode of the optical cell and resistor R43 across the power supply $U_B$. The keyboards TA2 and TA3 are connected to the point of connection between the resistors R43 and the photodiode of the optical cell. Thus, the current flowing through the photodiode will control the phototransistor in the optical cell to provide control over the voltage tuned active filter connected thereto.

A plurality of band pass filters $F_{const1}$ through $F_{constn}$ are also connected to the output of the tone generator G. Each of these filters corresponds generally in configuration to the voltage tuned active filters but are controlled only by the keyboards TA2 and TA3 via the lines 121 and 122.

The damping member D includes an operational amplifier AMP whose difference input is connected in common to the output lines from each of the voltage tuned active filters and the band pass filters in the filter arrangement F. Each of the lines from the filters includes a pair of resistors, such as resistors R44 and R45 which are controlled from the keyboard TA3 via lines 122. In a simple embodiment of a damping member, resistive voltage dividers with LC filters may be utilized in place of more complicated systems using operational amplifiers.

Figure 7:
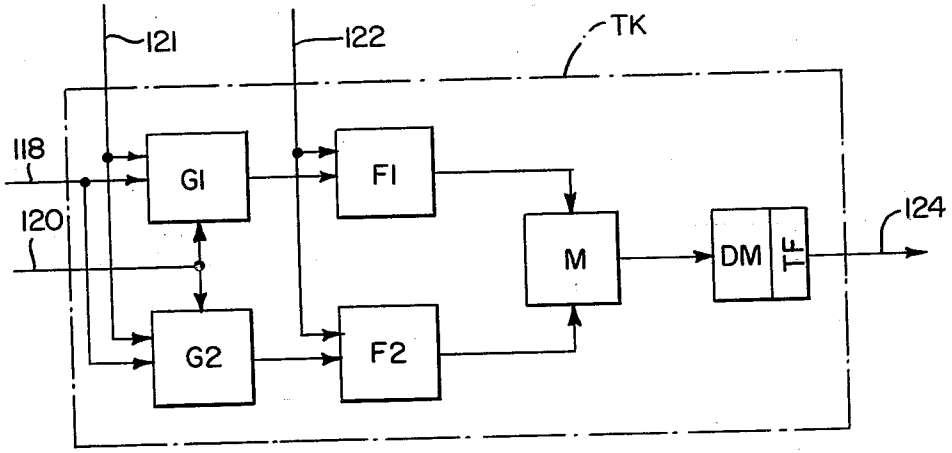
Figure 8:
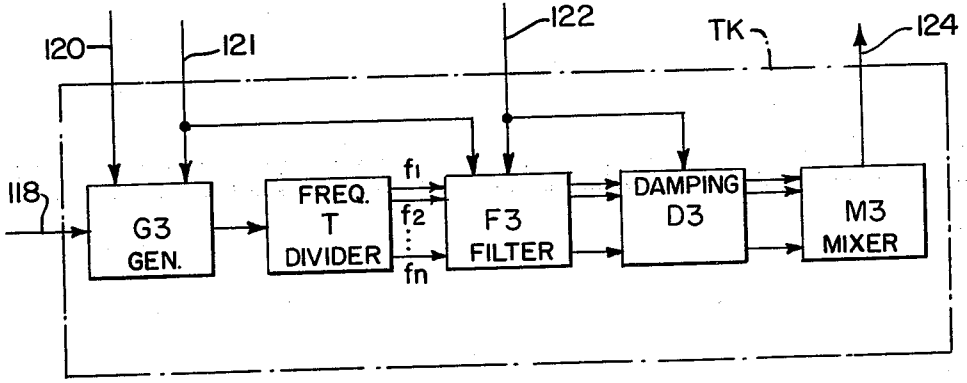

Another example of a tone and sound generating unit TK which makes use of high frequencies and a well-known frequency difference method is illustrated in FIG. 7. Two controllable and connectable high frequency generators G1 and G2 supplying sawtooth or square-waved output voltages of different high frequencies are respectively connected to identical filters F1 and F2 to provide parallel paths for the signal received from the first amplifier V1 via line 118. Each of the generators G1 and G2 are frequency-controlled by the keyboard TA2 via line 121, and the operation of these generators G1 and G2 is controlled via line 20 from the switching amplifier SV, to provide selective on-off control. The filters F1 and F2 are also operated simultaneously in response to the setting of the keyboard TA3 and represented by signals on line 122. A mixer M mixes the outputs of the filters F1 and F2. The frequency of the output of mixer M is the difference of the two high frequencies and lies in the low frequency range. The mixer M applies its output to an amplitude demodulator DM which amplifies and demodulates the resultant signal and passes it on to a filter TF for filtering the high frequency voltage. The frequency of the generators G1 and G2 can be switched in a stepwise manner by the keyboard TA2 to vary the tone frequency on line 12, and the filters F1 and F2 can be controlled by the keyboard TA3 to vary the sound pattern. A further example of a tone and sound generating unit TK is illustrated in FIG. 8. It makes use of a frequency addition method. A controllable and connectable generator G3 operates in the high frequency range. A frequency divider T connected to the output of the generator G3 is controlled by the generator frequency. It has *n* output lines and supplies there signals having frequencies *f*1 to *fn* in the low frequency range. These frequency signals are filtered in parallel by a filter F3, damped by a damper D3, and then mixed by a mixer M3. The high frequency of the generator G3 can be switched in a stepwise manner and the resonant frequency of the filter F is controlled by the keyboard TA2 via line 121. The filter F3 and the damping member D3 are swtiched by the keyboard TA3 via line 122 to change the sound pattern, in the manner as described previously.

Figure 9:
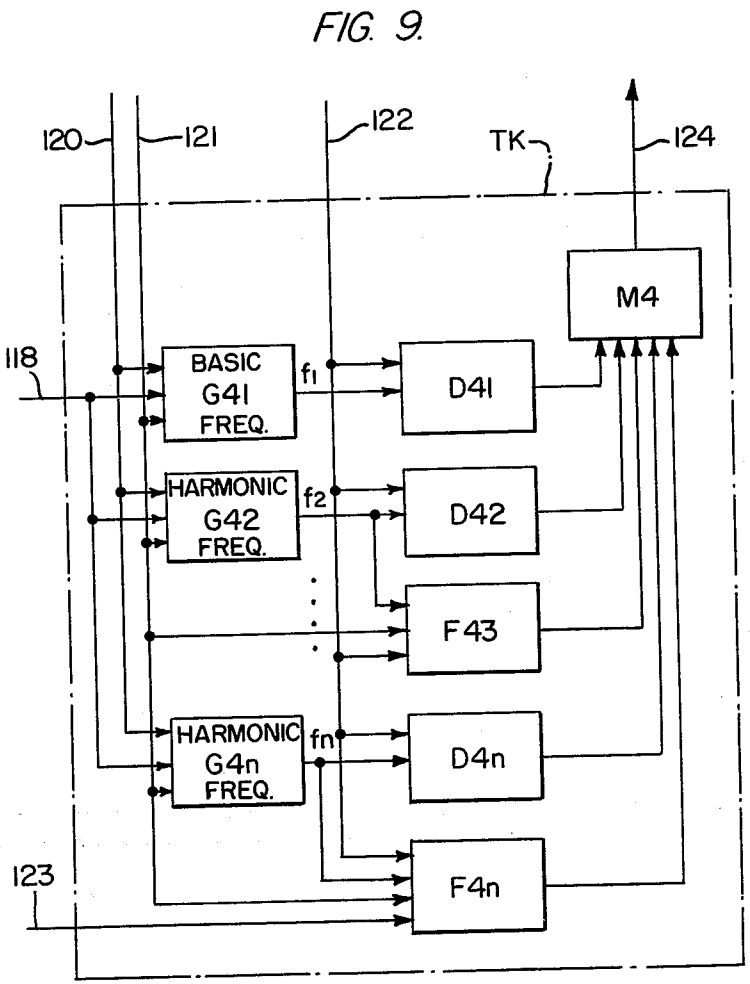
FIGS. 7 through 10 are schematic block diagrams of respective tone and sound generating units which may be used in the system of FIG. 6.

A further example of a tone and sound generating unit TK which may be used in accordance with the present invention is illustrated in FIG. 9. It makes use of a frequency addition method, too. A plurality of *n* parallel controllable and connectable generators G41 through G4*n* operate in the low frequency range. The generator G41 produces the basic frequency F1, while the remaining generators G42 through G4*n* produce the harmonic waves having generator frequencies *f*2 through *fn*. The voltages produced by the generators G41 through G4*n* only include very few harmonic frequencies. The generator frequencies *f*1 through *fn* are damped in parallel by the damping members D41 through D4*n* connected to respective outputs of the generators, possibly filtered by the filters F1 through F*n* (only filter F4*n* is shown in Figure) and are mixed by a mixer M4 to form a frequency spectrum. The generator frequencies *f*1 through *fn* of the generators G41 through G4*n* can be switched in a stepwise manner and the resonant frequency of the filters F41 through F4*n* can be switched by the keyboard TA2. The filters F41 through F4*n* and the damping members D41 through D4*n* can be switched by the keyboard TA3 to vary the sound pattern.

Figure 10:
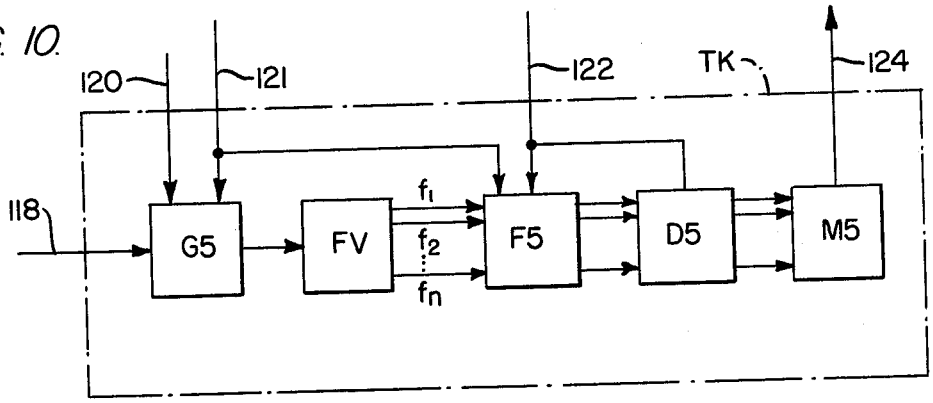

Still another example of a tone and sound generating unit TK is illustrated in FIG. 10. The controllable and connectable generator G5 operates in the low frequency range. The generator G5 frequency controls a frequency multiplier FV producing a plurality of output frequencies *f*1 through *fn* which are filtered by parallel filters F, damped by a damping member D5 and again mixed in a mixer M5. The frequency of the generator G5 and the resonant frequency of the filter F5 may be switched in a stepwise manner via the keyboard TA2. The filter F5 and the damping member D5 may be switched by the keyboard TA3 to change the sound pattern, in the manner described.

Figure 11:
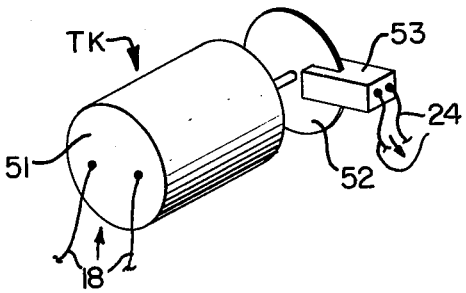
FIG. 11 is a schematic illustration of another form of tone generator.

FIG. 11 illustrates another example of a tone generating apparatus which comprises a motor 51, the speed of which is controlled in response to the pitch determining measurement from the output of the first amplifier V1 in FIG. 6. A tone and sound plate 52 is connected to the motor and rotated thereby. The plate 52 has a radius which changes with a rotation thereof of 360° according to a function that corresponds to the desired sound function. The function may be repeated many times on the periphery of the plate. This plate 52 is associated with an electrical reading device 53. If the plate 52 turns in response to application of the signal on line 118 to the motor 51, then with the changing radius of the plate 52, the light beam will be modulated and detected.

The tone generating apparatus may also comprise a cathode ray tube including an outer sound-forming element which is scanned by means of a light spot of an electronic beam. The level of the light output of the cathode ray tube is integrated for producing an electrical signal in response thereto.

While I have shown and described various embodiments of the present invention, it is to be understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. An electronic musical instrument providing continuous cybernetic tone finding controlled by the functions of the human mouth, comprising a mouthpiece into which air is to be blown from the mouth of the player;

measuring means mounted at least in part of said mouthpiece for producing a pitch determining signal representing a measure of the mouth cavity of the player and a volume determining signal representing the velocity or pressure of the air blown into the mouthpiece;

tone generating means for generating a tone signal whose frequency varies with the level of a control signal applied thereto;

first control means responsive to said pitch determining signal for applying to said tone generating means a control signal having a level representing a measure of the mouth cavity of the player;

amplifier means having a variable amplification for amplifying the output of said tone generating means;

second control means responsive to said volume determining signal for varying the amplification of said amplifier means; and means for converting the output of said amplifier means to sound.

2. An electronic musical instrument as defined in claim 1 wherein said tone generating means includes at least one tone generator which is enabled upon receipt of an enabling signal, said second control means including a control amplifier connected to receive said volume determining signal and a switching amplifier responsive to an output of said control amplifier for applying an enabling signal to said tone generator.

3. An electronic musical instrument as defined in claim 1 wherein said means to convert the output of said amplifier means to sound is an electro-acoustical transducer, and further including a power amplifier connected between said amplifier means and said transducer.

4. An electronic musical instrument as defined in claim 1 wherein said first control means is responsive to both said pitch determining signal and an output of said second control means for controlling the level of the control signal applied to said tone generating means.

5. An electronic musical instrument as defined in claim 1 wherein said measuring means is mounted entirely in said mouthpiece.

6. An electronic musical instrument as defined in claim 1 further including a vibrato generator capable of producing a variable frequency modulation signal in response to selective control from a keyboard, said vibrato generator having respective outputs connected to said first and second control means.

7. An electronic musical instrument as defined in claim 6 wherein said first control means comprises a first amplifier having respective inputs receiving one output of said vibrato generator and said pitch determining signal and a first potentiometer connected to said first amplifier for controlling the range of the output thereof connected to said tone generator means.

8. An electronic musical instrument as defined in claim 7 wherein said second control means comprises a second amplifier having respective inputs receiving a second output of said vibrato generator and said volume determining signal a switching amplifier for generating an enabling signal to enable operation of said tone generator means, said second amplifier providing respective outputs in control of the amplification of said amplifier means and said first amplifier in said first control means and an output to said switching amplifier.

9. An electronic musical instrument as defined in claim 1 wherein said measuring means includes pitch determining means for measuring the mouth cavity of the player and volume determining means for measuring the pressure of the air blown into the mouthpiece.

10. An electronic musical instrument as defined in claim 9 wherein said pitch determining means comprises a signal transmitter positioned to transmit a signal into the mouth cavity, a signal receiver positioned to receive a signal from the mouth cavity, an amplifier connected between the output of said receiver and the input of said transmitter, and a frequency/analog voltage converter connected to receive the output of said amplifier.

11. An electronic musical instrument as defined in claim 10 wherein a diode rectifier is connected to the output of said amplifier to rectify the received frequency.

12. An electronic musical instrument as defined in claim 9 wherein said pitch determining means comprises transmitted means for transmitting a constant frequency signal into the mouth cavity and receiver means including an amplifier and a diode rectifier for amplifying and rectifying a signal received from the mouth cavity.

13. An electronic musical instrument as defined in claim 12, further including a frequency/analog voltage converter connected to the output of said receiver means.

14. An electronic musical instrument as defined in claim 9 wherein said pitch determining means comprises means for measuring the distance between the mouthpiece and the tongue of the player including a light emitter and a light receiver disposed in the mouthpiece in side-by-side fashion so that light beamed into the mouth cavity by the light emitter is received after reflection from the tongue by the light receiver, said light receiver providing a signal representative of the measured distance.

15. An electronic musical instrument as defined in claim 14 wherein said light emitter includes at least one light emitting diode and said light receiver includes at least one photo-transistor.

16. An electronic musical instrument as defined in claim 14 wherein said light emitter and said light receiver are mounted in a holder made of opaque material.

17. An electronic musical instrument as defined in claim 16 wherein said light emitter and said light receiver are mounted in separate cavities in said holder and a parabolic reflector having a light emitting coating is provided in each cavity.

18. An electronic musical instrument as defined in claim 17 wherein said cavities are covered by a single plane parallel transparent plate.

19. An electronic musical instrument as defined in claim 17 wherein said cavities are individually covered with transparent material.

20. An electronic musical instrument as defined in claim 9 wherein said volume determining means comprises a resistance bridge circuit including a first measuring resistor disposed in said mouthpiece in the path of air blown therein and a second measuring resistor shielded from said air, said first and second measuring resistors being connected to a direct current power source, and means for detecting an unbalanced condition of said bridge circuit resulting from a change in resistance of one of said first and second measuring resistors.

21. An electronic musical instrument as defined in claim 20, further including heater means for heating said first and second measuring resistors.

22. An electronic musical instrument as defined in claim 9 wherein said volume determining means comprises an element movably mounted in said mouthpiece in the path of air blown therein so as to be displaced by said air to an extent determined by the air pressure, detector means for detecting the extent of movement of said element and means responsive to said detector means for generating an electrical signal representative of the extent of movement of said element.

23. An electronic musical instrument as defined in claim 22 wherein said mouthpiece includes at least one elongated passage into which air is blown at one end, said element comprising a cover resiliently mounted over the other end of said elongated passage, said signal generating means comprising a light emitter and a light transducer disposed along an optical path, and said detector means comprising a light shield secured to said cover and disposed at least in part in said optical path.

24. An electronic musical instrument as defined in claim 23 wherein said cover is connected to one end of a resilient spring, said light shield also being connected to said spring so as to move with said cover.

25. An electronic musical instrument as defined in claim 24 wherein said spring has a coiled portion provided with a vibration damping material.

26. An electronic musical instrument as defined in claim 9 wherein said volume determining means comprises a chamber disposed in said mouthpiece having an inlet into which air is blown and a restricted outlet, said chamber having a flexible wall which is displaced in accordance with the air pressure in the chamber, means for detecting movement of said flexible wall, and means responsive to said detecting means for generating a signal indicative of the extent said flexible wall is displaced.

27. An electronic musical instrument as defined in claim 26 wherein said detecting means comprises a plunger secured to one end of a coil spring and resting on said flexible wall, and a light shield connected to said plunger, said signal generating means comprising a light emitter and a light transducer disposed along an optical path, said light shield being disposed at least in part in said optical path.

28. An electronic musical instrument as defined in claim 27 wherein said coil spring is provided with a vibration damping material.

29. An electronic musical instrument as defined in claim 8 wherein said second amplifier in said second control means is connected to a potentiometer for changing the frequency range of the output thereof.

30. An electronic musical instrument as defined in claim 1 wherein said tone generating means comprises a low frequency tone generator and at least one sound pattern-determining filter connected to the output of said generator.

31. An electronic musical instrument as defined in claim 1 wherein said tone generating means comprises first and second high frequency generators, first and second filters connected to the outputs of said first and second generators, respectively, a mixer connected to said first and second filters and an amplitude demodulator connected to the output of said mixer.

32. An electronic musical instrument as defined in claim 31 wherein said first generator produces a constant frequency signal and said second generator produces a signal whose frequency varies with said control signal.

33. An electronic musical instrument as defined in claim 31 wherein said first and second generators are controlled unequally by said control signal.

34. An electronic musical instrument as defined in claim 1 wherein said tone generating means comprises a high frequency generator, a frequency divider connected to said generator, a filter connected to said divider, a damping member connected to said filter, and a mixer connected to said damping member.

35. An electronic musical instrument as defined in claim 1 wherein said tone generating means comprises a plurality of tone generators, a plurality of damping members each connected to the output of a respective tone generator, and a mixer connected in common to the outputs of said damping members.

36. An electronic musical instrument as defined in claim 35 wherein said tone generators provide output signals at frequencies which remain constant relative to one another over a prescribed controllable range and the frequency spectrum of the individual generator voltages is characterized by the absence of harmonic waves.

37. An electronic musical instrument as defined in claim 35, further including a plurality of filters connected in parallel with said damping members to said tone generators, the outputs of said filters being connected to said mixer.

38. An electronic musical instrument as defined in claim 1 wherein said tone generating means comprises a low frequency tone generator, a frequency multiplier circuit connected to the output of said generator, filter means connected to the output of said frequency multiplier circuit, damping means connected to the output of said filter means, and a mixer connected to the output of said damping means.

39. An electronic musical instrument as defined in claim 38 wherein said tone generator produces a sawtooth output voltage.

40. An electronic musical instrument as defined in claim 38 wherein said tone generator produces a square-wave output voltage.

41. An electronic musical instrument as defined in claim 1 wherein said tone generator means includes at least one tone generator whose output frequency is controlled by a variable resistance.

42. An electronic musical instrument as defined in claim 1 wherein said tone generator means includes at least one tone generator, and keyboard means for controlling the output frequency of said tone generator in a step-wise manner.

43. An electronic musical instrument as defined in claim 1 wherein said tone generating means includes at least one tone generator and a controllable filter connected to the output of said tone generator, and further including keyboard means connected to said controllable filter for controlling the frequency range thereof.

44. An electronic musical instrument as defined in claim 1 wherein said tone generating means comprises at least one tone generator, a filter connected to the output of said tone generator, and controllable damping member connected to the output of said filter, and further including keyboard means for selectively controlling said damping member.

45. An electronic musical instrument as defined in claim 43 including means for adjusting said filter in response to the output of said first control means.

46. An electronic musical instrument as defined in claim 1 wherein said tone generating means comprises a motor, means for controlling the speed of said motor in response to the output of said first control means, a tone and sound plate connected to said motor and provided with an indicator mounted thereon, and means for detecting the presence of said indicator at a predetermined position.

47. An electronic musical instrument as defined in claim 7 wherein said first amplifier modulates the pitch determining signal in accordance with the output of said vibrato generator and said first potentiometer serves to vary the modulation level of the output signal of said first amplifier under control of a keyboard.

48. An electronic musical instrument providing continuous cybernetic tone finding controlled by the functions of the human mouth, comprising a mouthpiece into which air is to be blown from the mouth of the player;

measuring means mounted at least in part of said mouthpiece for producing a pitch determining signal representing a measure of the mouth cavity of the player and a volume determining signal representing the velocity or pressure of the air blow into the mouthpiece, said measuring means including pitch determining means for measuring the mouth cavity of the player and volume determining means for measuring the pressure of the air blown into the mouthpiece, said pitch determining means including a signal transmitter positioned to transmit a signal into the mouth cavity, a signal receiver positioned to receive a signal from the mouth cavity, an amplifier connected between the output of said receiver and the input of said transmitter, and a frequency/analog voltage converter connected to receive the output of said amplifier;

tone generating means for generating a tone signal whose frequency varies with the level of a control signal applied thereto;

first control means responsive to said pitch determining signal for applying to said tone generating means a control signal having a level representing a measure of the mouth cavity of the player;

second control means responsive to said volume determining signal for supplying a modulation signal, modulation means for modulating the output of said tone generating means in response to said modulation signal, and means for converting the output of said modulation means to sound.

49. An electronic musical instrument providing continuous cybernetic tone finding controlled by the functions of the human mouth, comprising a mouthpiece into which air is to be blown from the mouth of the player;

measuring means mounted at least in part of said mouthpiece for producing a pitch determining signal representing a measure of the mouth cavity of the player and a volume determining signal representing the velocity or pressure of the air blown into the mouthpiece, said measuring means includes pitch determining means for measuring the mouth cavity of the player and volume determining means for measuring the pressure of the air blown into the mouthpiece, said pitch determining means including means for measuring the distance between the mouthpiece and the tongue of the player including a light emitter and a light receiver disposed in the mouthpiece in side-by-side fashion so that light beamed into the mouth cavity by the light emitter is received after reflection from the tongue by the light receiver, said light receiver providing a signal representative of the measured distance;

tone generating means for generating a tone signal whose frequency varies with the level of a control signal applied thereto;

first control means responsive to said pitch determining signal for applying to said tone generating means a control signal having a level representing a measure of the mouth cavity of the player;

second control means responsive to said volume determining signal for supplying a modulation signal, modulation means for modulating the output of said tone generating means in response to said modulation signal, and means for converting the output of said modulation means to sound.

* * * * *